US011635268B2

(12) United States Patent
Nielsen

(10) Patent No.: US 11,635,268 B2
(45) Date of Patent: Apr. 25, 2023

(54) RIFLE BOLT DISASSEMBLY TOOL

(71) Applicant: Kristian Nielsen, Chicago, IL (US)

(72) Inventor: Kristian Nielsen, Chicago, IL (US)

(73) Assignee: TITAN PRODUCT DEVELOPMENT, LLC, Chicago, IL (US)

( * ) Notice: Subject to any disclaimer, the term of this patent is extended or adjusted under 35 U.S.C. 154(b) by 0 days.

(21) Appl. No.: 17/712,022

(22) Filed: Apr. 1, 2022

(65) Prior Publication Data

US 2022/0333885 A1 Oct. 20, 2022

Related U.S. Application Data

(60) Provisional application No. 63/176,844, filed on Apr. 19, 2021.

(51) Int. Cl.

| | |
|---|---|
| ***F41A 11/00*** | (2006.01) |
| *F41A 35/00* | (2006.01) |
| *F41C 27/00* | (2006.01) |

(52) U.S. Cl.

CPC ..... *F41A 11/00* (2013.01); *F41A 35/00* (2013.01); *F41C 27/00* (2013.01)

(58) Field of Classification Search

CPC ..... F41A 11/00; F41A 35/00; F41C 27/00

See application file for complete search history.

(56) References Cited

U.S. PATENT DOCUMENTS

| | | | | |
|---|---|---|---|---|
| 2,373,141 | A * | 4/1945 | Orloff | F41A 11/00 42/108 |
| 8,091,266 | B2 * | 1/2012 | Huang | F41A 35/00 42/108 |
| 8,800,193 | B1 * | 8/2014 | Frear, Jr. | F41A 35/00 42/108 |
| 2006/0162224 | A1 * | 7/2006 | Connal | F41C 27/00 42/108 |
| 2009/0199345 | A1 * | 8/2009 | Morgan | F41A 29/02 42/108 |
| 2010/0095576 | A1 * | 4/2010 | Johns | F41A 21/00 42/108 |
| 2015/0020428 | A1 * | 1/2015 | Jenkinson | F41A 21/00 42/108 |
| 2015/0121742 | A1 * | 5/2015 | Wilkinson | F41A 11/00 42/108 |
| 2022/0042764 | A1 * | 2/2022 | Ray | F41C 23/20 |

OTHER PUBLICATIONS

Brownells—Remington Bolt Disassembly Tool; https://www.youtube.com/watch?v=SCFSWOCJDLI; Nov. 30, 2011 (Year: 2011).*

* cited by examiner

*Primary Examiner* — Joshua E Freeman

(74) *Attorney, Agent, or Firm* — Justin Lampel

(57) ABSTRACT

A rifle bolt disassembly tool is provided. The rifle bolt disassembly tool has a fulcrum having a tooth and a lever. The tool is suitable for allowing a user to unscrew the bolt plug of the rifle in a safe and efficient manner. The present tool is especially suitable to remove the bolt plug of a Remington Model 700 rifle, but may also be used with other rifles.

12 Claims, 7 Drawing Sheets

RIFLE BOLT DISASSEMBLY TOOL

CROSS REFERENCE TO RELATED APPLICATIONS

The following application is a based on and claims the priority benefit of U.S. provisional application Ser. No. 63/176,844 filed Apr. 19, 2021; the entire content of which is incorporated by reference.

BACKGROUND OF THE INVENTION

A rifle bolt disassembly tool is provided. The rifle bolt disassembly tool has a fulcrum having a tooth and a lever. The tool is suitable for allowing a user to unscrew the bolt plug of the rifle in a safe and efficient manner. The present tool is especially suitable to remove the bolt plug of a Remington Model 700 rifle, but may also be used with other rifles.

Tools for working on rifles are known. For example, U.S. Pat. No. 10,724,819 to Strombeck discloses systems, and methods for the maintenance, repair, modification, cleaning, disassembly, and reassembly of firearms and firearm components. Particular embodiments include tools to aid in the removal and insertion of an extractor pin from the bolt assembly of an AR-15 or M-16 rifle. Preferred embodiments are directed to bolt assemblies for 0.223 and 0.308 imperial caliber firearms, as well as 5.56 and 7.62 metric caliber firearms. The tools include a housing with a channel to receive the bolt, a channel to insert a locking rod to orient and secure the bolt in the housing, a channel for inserting a removal rod to remove the extractor pin from the bolt or an inserting rod to insert the extractor pin into the bolt.

Further, U.S. Pat. No. 8,695,477 to Esch discloses an assembly tool for a bolt catch on a firearm having a bolt that slides between a latched position and an unlatched position, the bolt held in the latched position by a bolt catch mechanism that includes a catch-release actuator pivotally mounted on the rifle to provide for latching and unlatching of the bolt by a user, the assembly including a lever having an L-shaped body that comprises a first leg and a second leg that is formed at substantially a right angle to the first leg, the first leg having a free end on which is formed a mounting member; and a clamp member structured to attach to the mounting member on the lever to enable clamping of the lever to the catch-release actuator in a manner that does not require disassembly of the firearm or disassembly or removal of the catch-release actuator from the firearm.

Still further, U.S. Pat. No. 9,279,634 to Shipman discloses a firearm bolt cleaning tool having a tool core defining a plurality of scraper surfaces. The scraper surfaces include a first gas ring scraper surface, a first bolt face scraper surface extending from a terminus of the first gas ring scraper surface, and a first bolt cylinder scraper surface extending from a terminus of the first bolt face scraper surface. Opposing positioned are a second gas ring scraper surface, a second bolt face scraper surface extending from a terminus of the second gas ring scraper surface, and a second bolt cylinder scraper surface extending from a terminus of the second bolt face scraper surface. The first gas ring scraper surface and the second gas ring scraper surface are spaced apart from each other at a distance that is less than a diameter of a cylindrical gas sealing ring holding section of the firearm bolt.

However, these patents fail to describe a rifle bolt disassembly tool which is easy to use. Further, these patents fail to provide for a rifle bolt disassembly tool which allows user to safely and quickly provide maintenance to a rifle.

SUMMARY OF THE INVENTION

A rifle bolt disassembly tool is provided. The rifle bolt disassembly tool has a fulcrum having a tooth and a lever. The tool is suitable for allowing a user to unscrew the bolt plug of the rifle in a safe and efficient manner. The present tool is especially suitable to remove the bolt plug of a Remington Model 700 rifle, but may also be used with other rifles.

An advantage of the present device is that the present device allows for the easy removal of the bolt plug of a rifle.

Another advantage of the present device is that the present device is small and light-weight.

Still another advantage of the present device is that the present device is durable.

For a more complete understanding of the above listed features and advantages of the rifle bolt disassembly tool reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A rifle bolt disassembly tool is provided. The rifle bolt disassembly tool has a fulcrum having a tooth and a lever. The tool is suitable for allowing a user to unscrew the bolt plug of the rifle in a safe and efficient manner. The present tool is especially suitable to remove the bolt plug of a Remington Model 700 rifle, but may also be used with other rifles.

Referring now to the figures, a rifle bolt disassembly tool 1 is provided. The tool 1 may have a fulcrum portion 10 having a tooth portion 20 of the fulcrum and a lever portion 30. The tool 1 is preferably made of a durable, non-corrosive metal.

Figure 6:
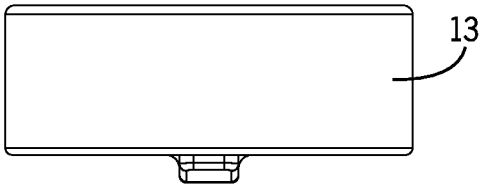
FIG. 6 illustrates a front view of the rifle bolt disassembly tool in one embodiment.
Figure 7:
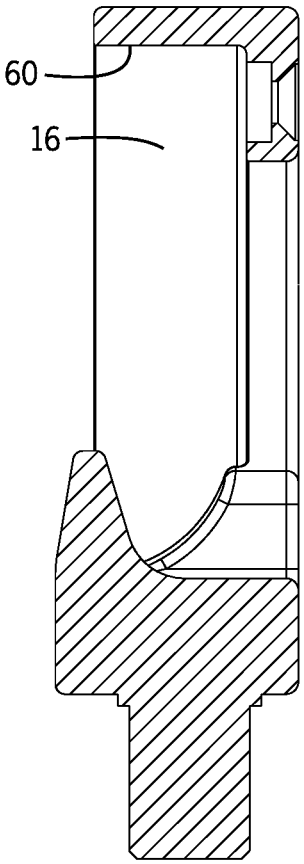
FIG. 7 illustrates a cross-sectional view of the side of the rifle bolt disassembly tool in one embodiment.
Figure 8:
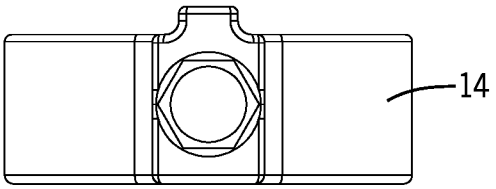
FIG. 8 illustrates a back view of the rifle bolt disassembly tool in one embodiment.
Figure 9:
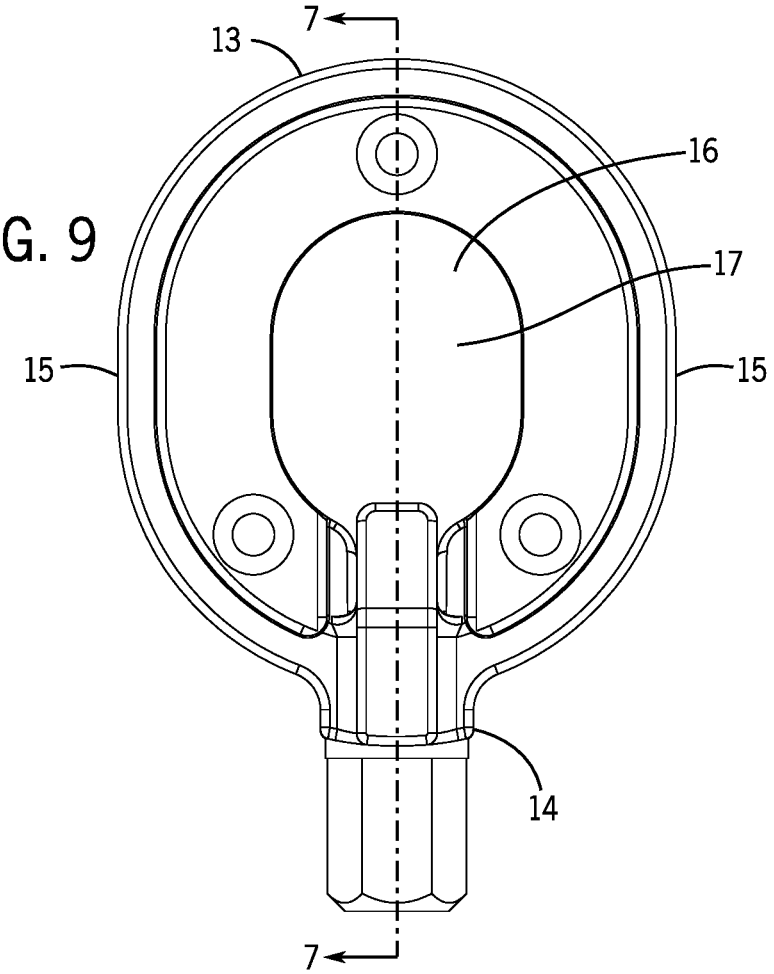
FIG. 9 illustrates a top view of the rifle bolt disassembly tool in one embodiment.
Figure 10:
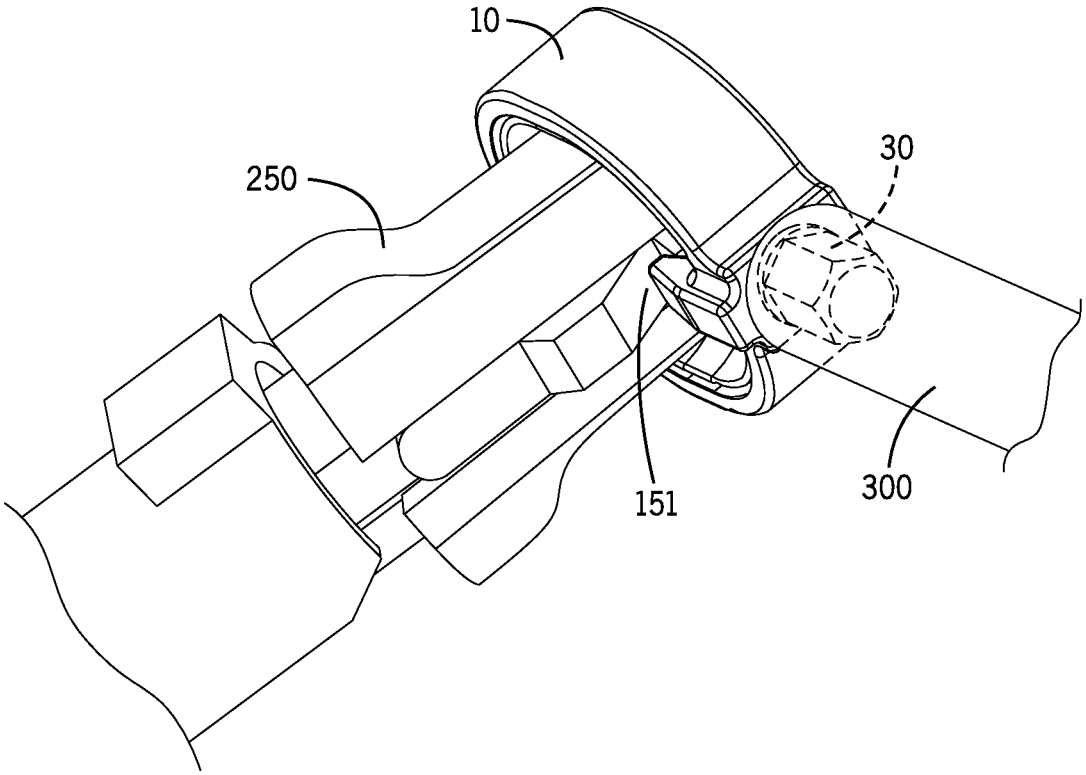
FIG. 10 illustrates the device being used on a firing pin head.
Figure 11:
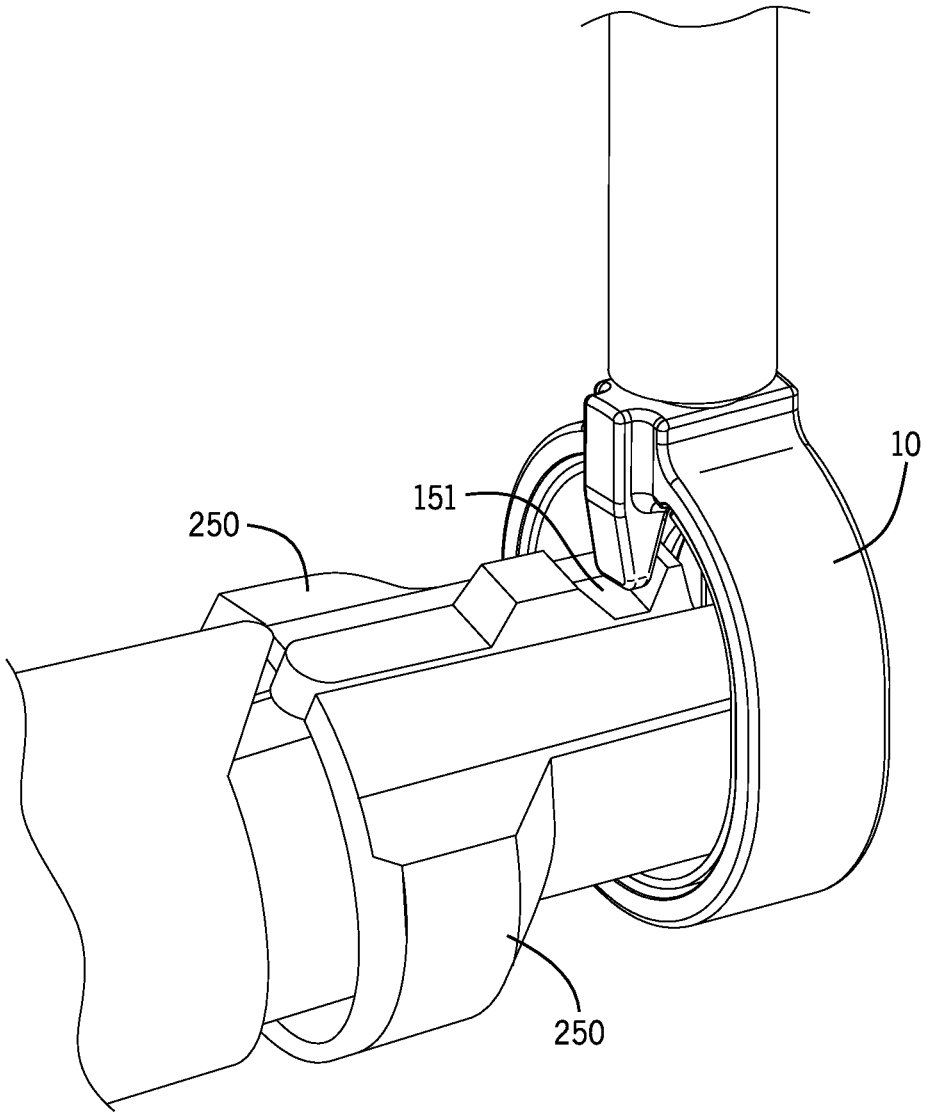
FIG. 11 illustrates a perspective view of the device being used on the firing pin head.
Figure 12:
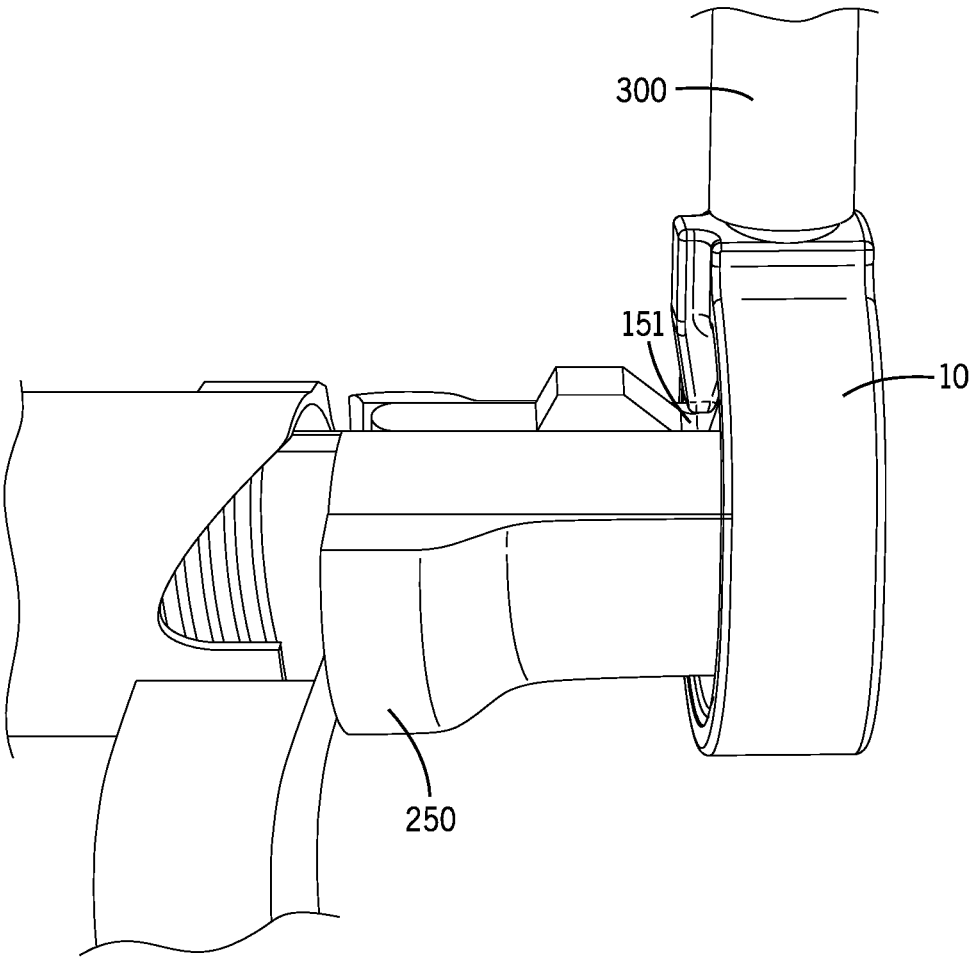
FIG. 12 illustrates a side view of the device being used on the firing pin head.

In an embodiment, the fulcrum portion 10 may have a top 11, a bottom 12, a front 13 (FIG. 6), a back 14 (FIG. 8), side portions 15 and an interior 16. In a preferred embodiment, the sides 15 are generally rounded so that the overall shape is oval; however, it should be understood that alternative shapes may be used.

Located within the interior 16 of the fulcrum portion 10 may an opening 17 having an interior wall 60. The opening 17 may have a width 18 and a length 19. The opening 17 may extend from the top 11 to the bottom 12 of the fulcrum portion 10 of the device 1. The width 18 and the length 19 of the opening 17 may be different from the top 11 of the device 1 to the bottom 12 of the device 1 (therein the interior wall 60 is not parallel or uniform or cylindrical). In particular, the width 18 and the length 19 of the opening at the top 11 of the fulcrum portion 10 may be greater than the respective width 18 and length 19 of the opening at the bottom 12 of the fulcrum portion 10 of the device 1. More specifically, the interior wall 60 of the opening 17 of the fulcrum portion 10 is preferably curved and gets narrower as it extends from the top 11 down toward the bottom 12 of the fulcrum portion 10. The interior walls 60 of the device 1 may be generally smooth and rounded so as to avoid leaving marks on the rifle bolt assembly 150 for which the tool 1 will be used.

Located at the top 11 of the tool 1 may be the tooth portion 20 of the fulcrum. The tooth portion 20 may have a front 21, a back 22, a first side 23, a second side 24, a top 25 and a bottom 26. The tooth portion 20 may be secured to the top 11 of the fulcrum portion 10, near the back 14 of the fulcrum portion 10 and may be integrally formed with the fulcrum portion 10. In an embodiment, the tooth portion 20 is generally square-shaped or rectangular-shaped with respect to the top surface 25 of the tooth portion 20. Further, in an embodiment, the tooth portion 20 is wedge-shaped from a side perspective (from the top to the bottom of the tooth portion 20) so as to better grasp the bolt and fit within a firing pin guide opening 151, as discussed below.

Located on the back 14 of the fulcrum portion 10 may also be the lever 30 portion. The lever portion 30 may be, for example, hexagonal-shaped so as to receive a monkey wrench (not shown). The lever portion 30 may receive a removable handle 300 which may temporarily secure the lever portion 30 of the device 1 and allow the device 1 to be manually operated.

Figure 1:
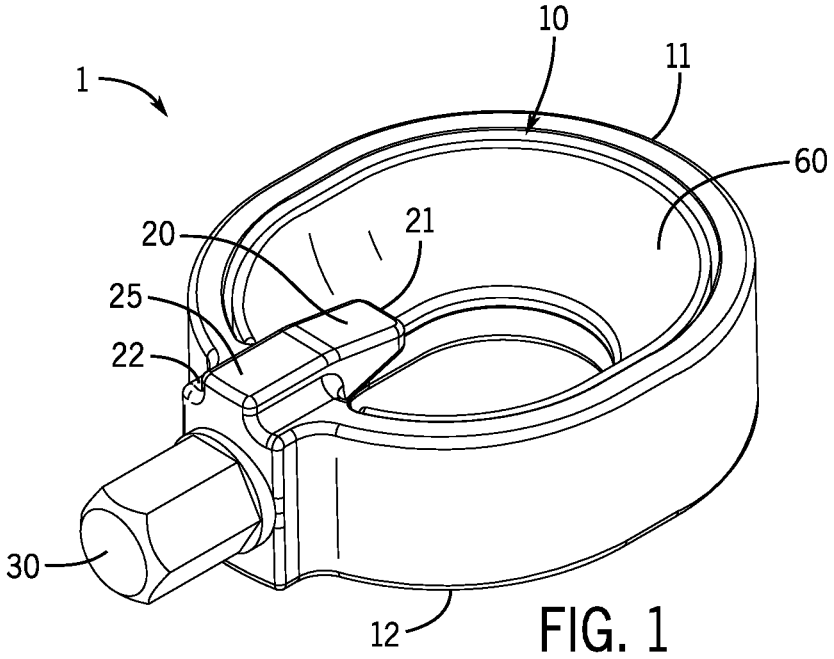
FIG. 1 illustrates a perspective view of the rifle bolt disassembly tool in one embodiment.
Figure 2:
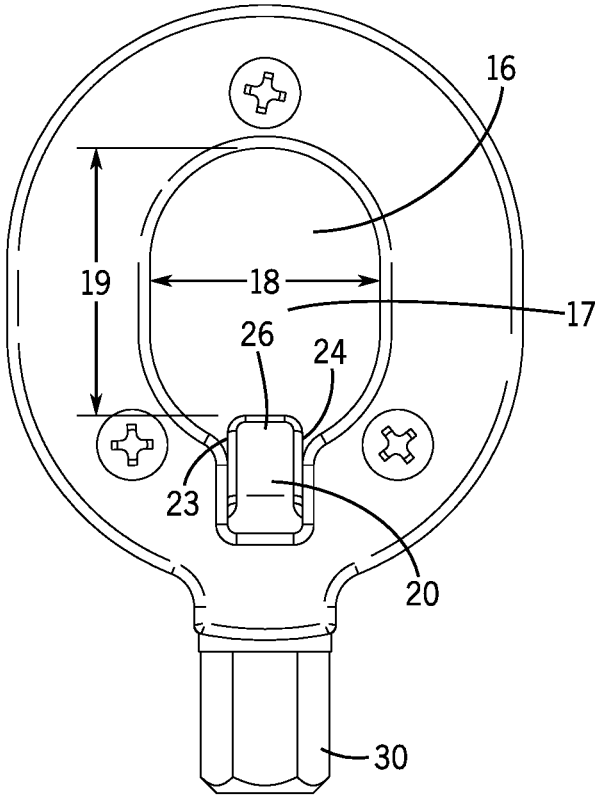
FIG. 2 illustrates a bottom view of the rifle bolt disassembly tool in one embodiment.
Figure 3:
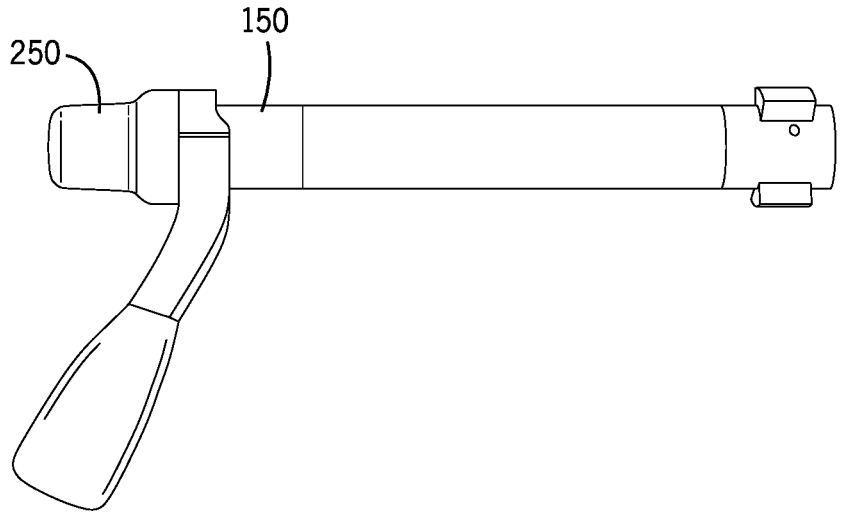
FIG. 3 illustrates a side view of an example of a rifle bolt for which the present rifle bolt disassembly tool might be used upon.
Figure 4:
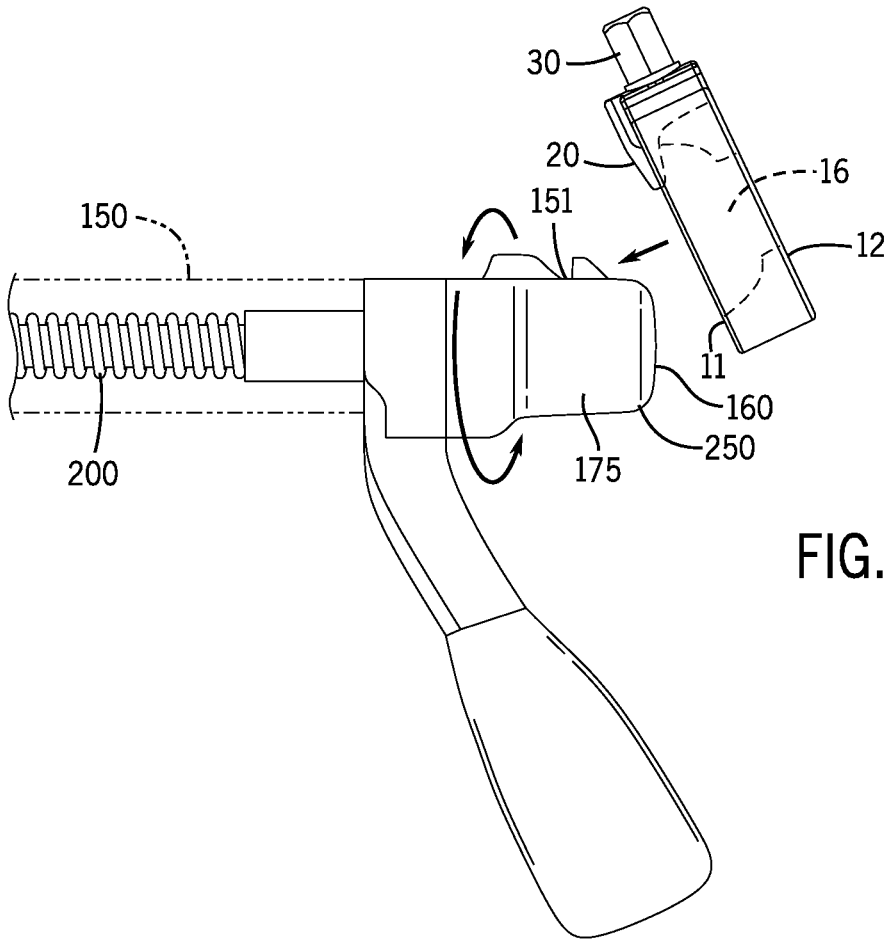
FIG. 4 illustrates the rifle bolt disassembly tool being used upon a rifle bolt plug.
Figure 5:
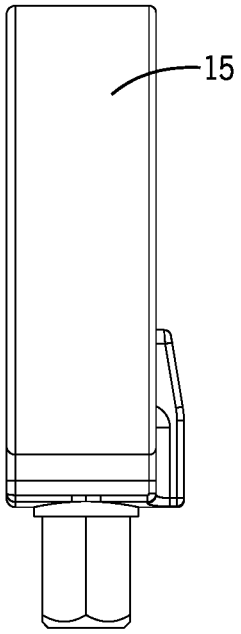
FIG. 5 illustrates a side view of the rifle bolt disassembly tool in one embodiment.

To use the device 1, a user first inserts the front 21 of the tooth portion 20 of the fulcrum into the firing pin guide opening 151 (FIG. 4) of the bolt plug 250 of the bolt assembly 150. Once the front 21 of the tooth portion 20 of the fulcrum is secured into the firing pin guide opening 151 of the bolt plug 250, the opening 16 of the fulcrum portion 10 is placed over the terminal end 160 of the rifle bolt plug 250 so that the top 11 (with the larger opening) of the fulcrum portion 10 contacts the terminal end 160 of the bolt plug 250 of the bolt assembly 150. A user then slightly pulls the lever 30 away from the bolt plug 250 so that the front 13 of the fulcrum portion 10 contacts the terminal end 160 of the bolt plug 250 and pulls the firing pin 151 outward from the bolt plug assembly 150. This compresses the internal spring 200 of the rifle. Once the spring 200 is compressed, the end of the bolt plug 175 may then be rotated in a three hundred and sixty degree manner and unscrewed from the main body of the bolt plug 250 for cleaning and maintenance. The removable handle 300 allows the device 1 to be rotated while at the same time that the internal spring 200 is compressed. This allows the rifle bolt plug 250 to be removed.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A rifle bolt disassembly tool comprising:

a fulcrum;

a tooth of the fulcrum;

a lever; and wherein the fulcrum has an opening and wherein the opening of the fulcrum is capable of receiving a portion of a rifle bolt of a rifle and therein the tooth is secured within a firing pin of a rifle and wherein the movement of the fulcrum pulls the rifle bolt away from the firing pin at the tooth.

2. The rifle bolt disassembly tool of claim 1 wherein the tool is made of a non-corrosive metal.

3. The refile bolt disassembly tool of claim 1 wherein the fulcrum has a top and a bottom and wherein the opening of the fulcrum passes from the top of the fulcrum through to the bottom of the fulcrum creating a passageway.

4. The refile bolt disassembly tool of claim 3 wherein the passageway of the fulcrum has non-parallel interior side walls.

5. The refile bolt disassembly tool of claim 3 wherein the passageway of the fulcrum is curved.

6. The refile bolt disassembly tool of claim 1 wherein the lever is located at a back of the fulcrum.

7. The refile bolt disassembly tool of claim 1 wherein the tooth is located between the lever and the fulcrum.

8. The rifle bolt disassembly tool of claim 1 wherein the lever has a front and a back and therein the back of the lever is hexagonal-shaped.

9. The rifle bolt disassembly tool of claim 1 wherein the tooth is secured to a top of the fulcrum.

10. The rifle bolt disassembly tool of claim 1 further comprising:

a handle portion removably secured to the lever portion.

11. The rifle bolt disassembly tool of claim 1 wherein the tooth is square-shaped or rectangular-shaped with respect to a top surface of the tooth.

12. The rifle bolt disassembly tool of claim 1 wherein the tooth is wedge-shaped.

* * * * *